US008584600B2

(12) United States Patent
Surinlert

(10) Patent No.: US 8,584,600 B2
(45) Date of Patent: Nov. 19, 2013

(54) FURNITURE SYSTEM AND METHOD

(75) Inventor: Arthit Surinlert, Bangkok (TH)

(73) Assignee: DMI Furniture, Inc., Louisville, KY (US)

( * ) Notice: Subject to any disclaimer, the term of this patent is extended or adjusted under 35 U.S.C. 154(b) by 0 days.

(21) Appl. No.: 13/279,955

(22) Filed: Oct. 24, 2011

(65) Prior Publication Data

US 2012/0097077 A1 Apr. 26, 2012

Related U.S. Application Data

(60) Provisional application No. 61/405,947, filed on Oct. 22, 2011.

(51) Int. Cl.
*A47B 1/02* (2006.01)

(52) U.S. Cl.
USPC ..... 108/79

(58) Field of Classification Search
USPC ..... 108/115, 77, 78, 79, 80–82; 312/313, 312/314, 315, 316, 317.1, 317.3, 205
See application file for complete search history.

(56) References Cited

U.S. PATENT DOCUMENTS

| | | | | | |
|---|---|---|---|---|---|
| 394,847 | A * | 12/1888 | French | 108/99 |
| 480,799 | A * | 8/1892 | Wilms | 312/277 |
| 842,821 | A * | 1/1907 | Tryon | 312/205 |
| 1,673,583 | A * | 6/1928 | Nystrom | 108/78 |
| 2,535,646 | A * | 12/1950 | Medwin | 108/63 |
| 3,306,690 | A * | 2/1967 | Gibson et al. | 312/208.5 |
| 5,865,517 | A * | 2/1999 | Wang | 312/237 |
| 7,481,502 | B2 * | 1/2009 | Ortiz et al. | 312/194 |
| 2004/0080244 | A1 * | 4/2004 | Lowther et al. | 312/205 |
| 2004/0123780 | A1 * | 7/2004 | Butts, Jr. | 108/26 |

* cited by examiner

*Primary Examiner* — Matthew Ing
(74) *Attorney, Agent, or Firm* — Frost Brown Todd LLC

(57) ABSTRACT

A furniture piece has a body, a surface, at least one moveable leg, and at least one stationary leg. The surface is in communication with the body and has a surface portion and a leaf portion. The leaf portion is moveable in relation to the surface portion. The at least one moveable leg is in communication with the body and is moveable between a retracted position and an extended position. The at least one moveable leg in the extended position is operable to provide structural support to the leaf portion. The at least one stationary leg is in communication with the body. The at least one stationary leg is affixed to the body such that the at least one stationary leg remains stationary in relation to the body.

16 Claims, 4 Drawing Sheets

FURNITURE SYSTEM AND METHOD

PRIORITY

This application claims priority to U.S. Provisional Patent Application Ser. No. 61/405,947, filed Oct. 22, 2011, entitled "Furniture System and Method," the disclosure of which is incorporated by reference herein.

BACKGROUND

There exist a variety of different types of furniture pieces. In many instances, furniture pieces are relatively stationary objects in a home having a single form factor, which may or may not be conducive to using the piece of furniture in different settings. For example, in some settings, an island, or other similar piece of furniture may not provide a enough surface space for use by a user. In other settings, the tabletop surface of a piece of furniture may be too large for use. Furthermore, different sizes of furniture may be desirable based on the space available. For example, if a large space is available, then a user may want to place a larger piece of furniture in that space. In other circumstances, a smaller space may be provided such that the user may wish instead to place a smaller piece of furniture in that space. In either of these scenarios, it may appear unaesthetic to have a piece of furniture that does not fit. For example, if a larger piece of furniture is placed in a smaller area, then the area surrounding the furniture may appear cramped. Conversely, if a smaller piece of furniture is placed in a large area, then the piece of furniture may appear awkwardly small. Given the stationary and/or static nature of furniture, in some cases it may not be possible to have a piece of furniture capable of filling both roles where in some instances more surface space may be desirable and in some instances where less surface space may be desirable depending on the space available. In some situations, traditional furniture may not be suitable as the user may desire different sizes for a piece of furniture based on the situation rather than the available space. For example, the user may wish to have larger furniture, such as an island or a table, in the event that the user is hosting a party and needs the extra space. In other situations, the user may wish to have smaller furniture if, for example, multiple people are in the room with the furniture, thus limiting the available space. Unfortunately, the user may not be able use a single piece of furniture in the various settings that has a single size configuration.

While a variety of furniture systems have been made and used, it is believed that no one prior to the inventor(s) has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
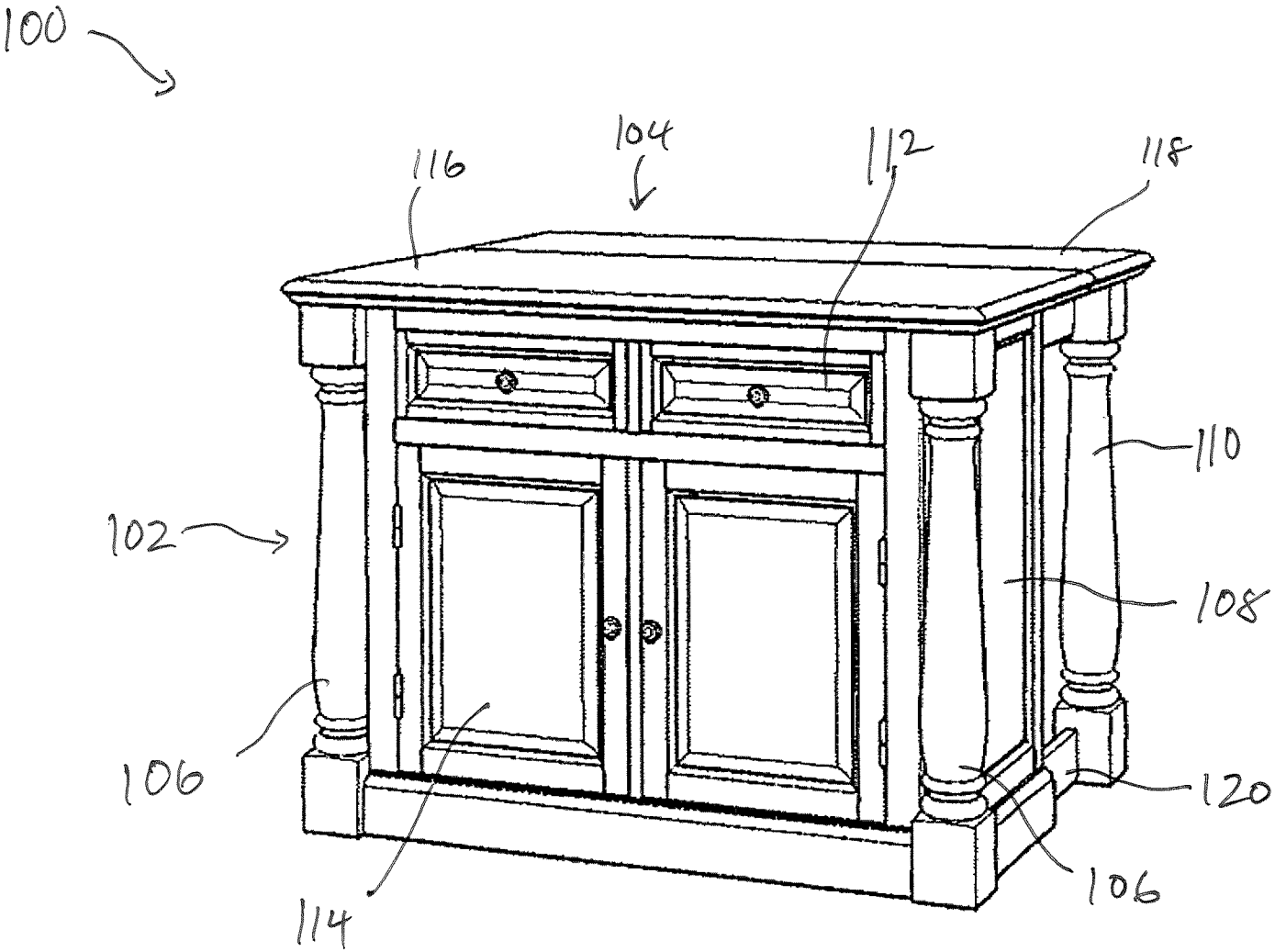
FIG. 1 depicts a front, perspective view of an exemplary furniture system.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

It will be appreciated that in some scenarios, it may be desirable to have a piece of furniture operable to alternate between providing a smaller surface and providing a larger surface. Such a piece of furniture may include an island, table, cart, buffet, desk, server, sideboards, or any other suitable furniture piece. For instance, if the user wishes to place many items on the furniture, then a larger surface may be desired. In other situations, if the user wishes to place a few items on the furniture, then a smaller surface may be desired. In some situations, it will be appreciated that a larger or smaller configuration may be desired depending on the space available. For example, if a smaller amount of space is available, then a smaller configuration for the furniture may be used. If a larger amount of space is available, then a larger configuration for the furniture may be used.

FIG. 1 shows an exemplary furniture system (100) having a base portion (102), a surface (104), stationary legs (106), side panels (108), and moveable legs (110). Also seen in FIG. 1 is a pair of drawers (112) and pair of cabinet doors (114). While the exemplary version shows two drawers (112) and two cabinet doors (114) it will be appreciated that any suitable number of drawers (112) and/or doors (114) may be used as would be apparent to one of ordinary skill in the art in view of the teachings herein. For example, 3, 4, 5, or more drawers (112) and/or doors (114) may be used. Furthermore, while the present example shows drawers (112) and doors (114) having a rectangular shape, any suitable shape for drawers (112) and doors (114) may be used. In some versions, drawers (112) and doors (114) may be omitted entirely. Indeed, furniture system (100) may be configured as an island as shown in the illustrated version; however, furniture system (100) may further have a table, cart, buffet, desk, server, sideboard, and/or any other suitable configuration. Other suitable variations will be apparent to one of ordinary skill in the art in view of the teachings herein.

Surface (104) comprises a main portion (116) and a moveable leaf (118). As can be seen, for example, in FIG. 2, moveable leaf (118) is moveable between a closed position and an opened position wherein leaf (118) is folded downward in the closed position and leaf (118) is extended outward in the opened position forming a continuous surface with main portion (116). Main portion (116) and leaf (118) may be connected using a hinge or any other suitable component operable to allow leaf (118) to move between the closed position and the open position. While the present example shows a hinge connecting main portion (116) and leaf (118), it will be appreciated that any suitable means of connecting main portion (116) and leaf (118) may be used as would be apparent to one of ordinary skill in the art in view of the teachings herein. For example, a ball and socket joint, a sliding connector, etc., or any other suitable connection means between main portion (116) and leaf (118) may be used. Furthermore, in the present example, leaf (118) has a rectangular shape, but any suitable shape may be used. For example, leaf (118) may have a rounded, circular, trapezoidal, or any other suitable shape as would be apparent to one of ordinary skill in the art in view of the teachings herein. Additionally, while the present example shows a single leaf (118) in communication with body portion (102), any suitable number of leaves (118) may be used as would be apparent to one of ordinary skill in the art in view of the teachings herein. For example, furniture system (100) may have 2, 3, 4, or any other suitable number of leaves (118).

Figure 2:
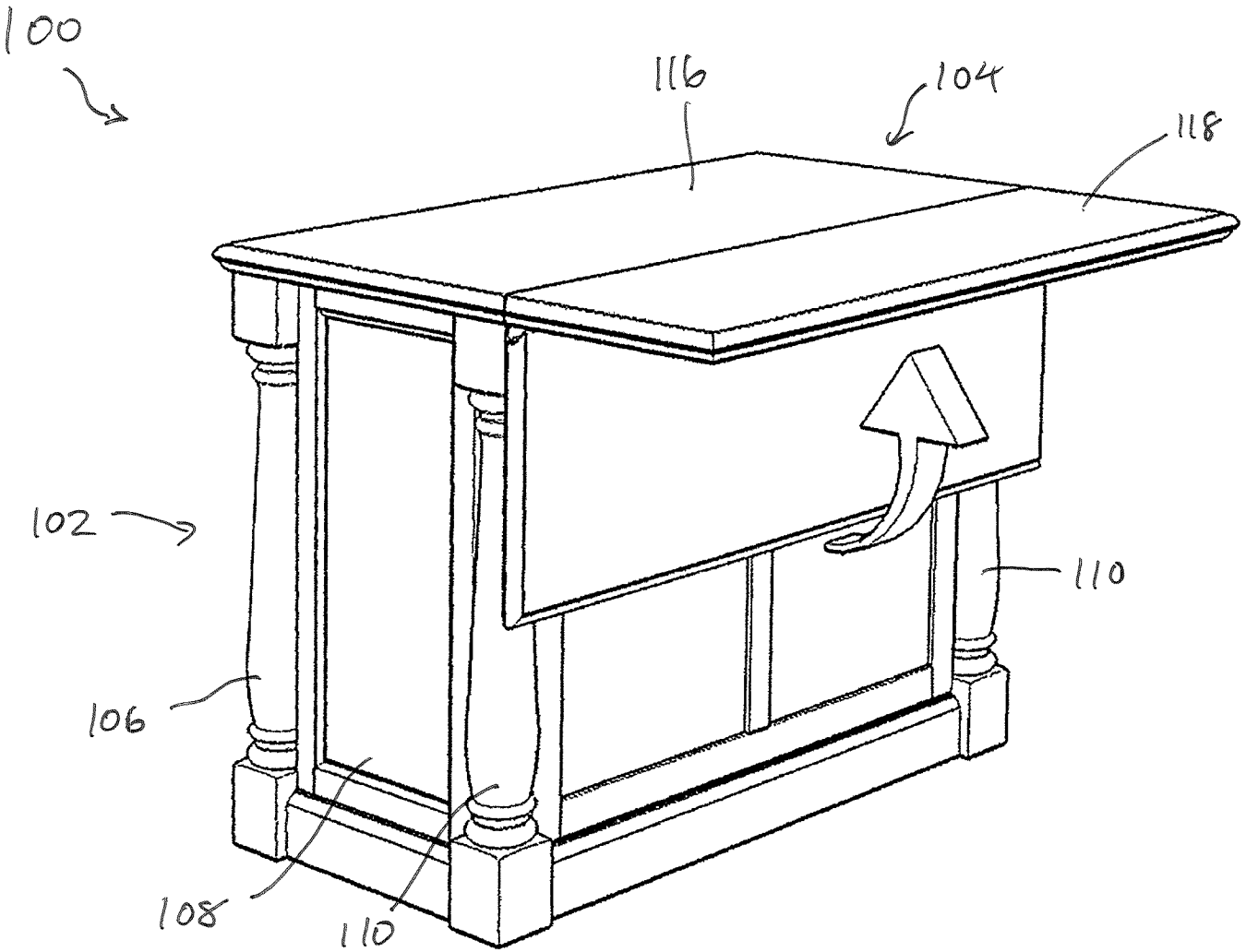
FIG. 2 depicts a rear, perspective view of the furniture system of FIG. 1.
Figure 3:
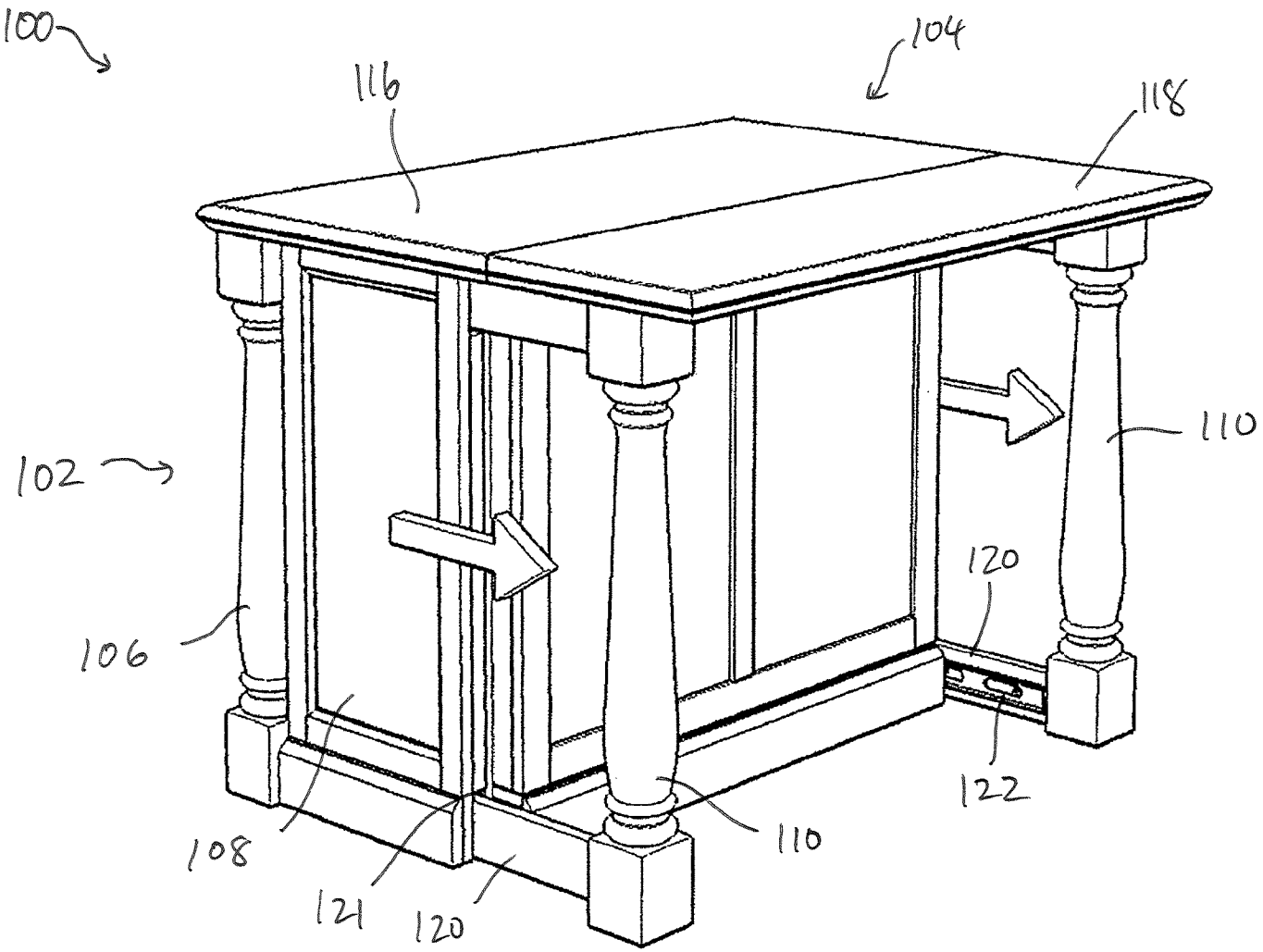
FIG. 3 depicts a rear, perspective view of the furniture system of FIG. 1 with moveable legs in an extended position.

Moveable legs (110) are operable to move between a retracted position and an extended position. For example, FIG. 2 shows moveable legs (110) in a retracted position where FIG. 3 shows moveable legs (110) in an extended position. The present example shows a pair of moveable legs (110), but it will be appreciated that any suitable number of moveable legs (110) may be used as would be apparent to one of ordinary skill in the art in view of the teachings herein. For example, a single moveable leg (110), or 2, 3, 4, 5, or any other suitable number of moveable legs (118) may be used. Furthermore, while the present example shows stationary legs (106) connected to base portion (102), it will be appreciated that in some instances stationary legs (106) may be omitted in favor of only using moveable legs (110). Moveable legs (110) are connected to beams (120) that extend into slots (121) of base portion (102) of furniture system (100). The present example shows two beams (120) attached to each moveable leg (110) where one beam (120) is attached to the top of moveable leg (110) and one beam (120) is attached to the bottom of moveable leg (110), thereby providing top and bottom supports for moveable leg (110) and also enabling the sliding of moveable leg (110) into body portion (102). While the present example shows one exemplary configuration for beam (120) other variations may be used as well. For example, while the present example shows two beams (120) attached to moveable leg (110), in some versions, a single beam (120) may be used or many beams (120) may be used. For example, 3, 4, 5, etc. beams (120) may be connected to each moveable leg (110). In the present example, beams (120) are connected to the top and bottom of each moveable leg (110), but it will be appreciated that in other versions, beams (120) may be connected to any suitable portion of moveable leg (110). For example, beams (120) may be connected to the center of moveable leg (110) or to any other suitable portion. Beams (120) of the present example also have a rectangular shape, but it will be appreciated that any suitable shape for beams (120) may be used as would be apparent to one of ordinary skill in the art in view of the teachings herein. For example, beams (120) may have a circular shape or any other suitable shape.

When moveable legs (110) are in a retracted position, which can be seem, for example, in FIG. 2, leaf (118) is folded down in the closed position. It will be appreciated that when moveable legs (110) are in the retracted position and leaf (118) is folded down, furniture system (100) has the appearance of a complete furniture piece while having a smaller footprint. Beams (120) are hidden such that the user cannot necessarily tell that moveable legs (110) may be extended. When moveable legs (110) are in an extended position, which can be seen, for example, in FIG. 3, leaf (118) is extended in the opened position providing a larger surface (104). Furthermore, furniture system (100) has a larger footprint as well. Moveable legs (110) are operable to support leaf (118) such that leaf (118) is operable to hold weight, which may include objects being placed upon leaf (118) by the user. When leaf (118) is extended in the opened position, surface (104) has a finished look such that the user or other observers cannot necessarily tell that leaf (118) may be folded down.

As can be seen in FIG. 3, beams (120) comprise a beam rail (122) positioned on the inside of beams (120). While the present example only shows beam rail (122) positioned on beam (120) at the bottom of moveable leg (110), it will be appreciated that a similarly constructed beam rail (122) may be positioned on beam (120) at the top of moveable leg (110). Beam rail (122) is in communication with a complementary set of rails contained in base portion (102) such that beam rail (122) is operable to provide smooth motion of moveable legs (110) from a retracted position to an extended position and vice versa. While in the exemplary version, a sliding rail system is used for beam rail (122), in other versions, any suitable mechanism may be used to enable moveable legs (110) to move from a retracted position to an extended position as would be apparent to one of ordinary skill in the art in view of the teachings herein. For example, roller bearings, frictional sliders, or any other suitable mechanisms may be used. In some versions, when moveable legs (110) are in an extended position, one or more locks and/or latches may be used to prevent movement of moveable legs (110).

Figure 4:
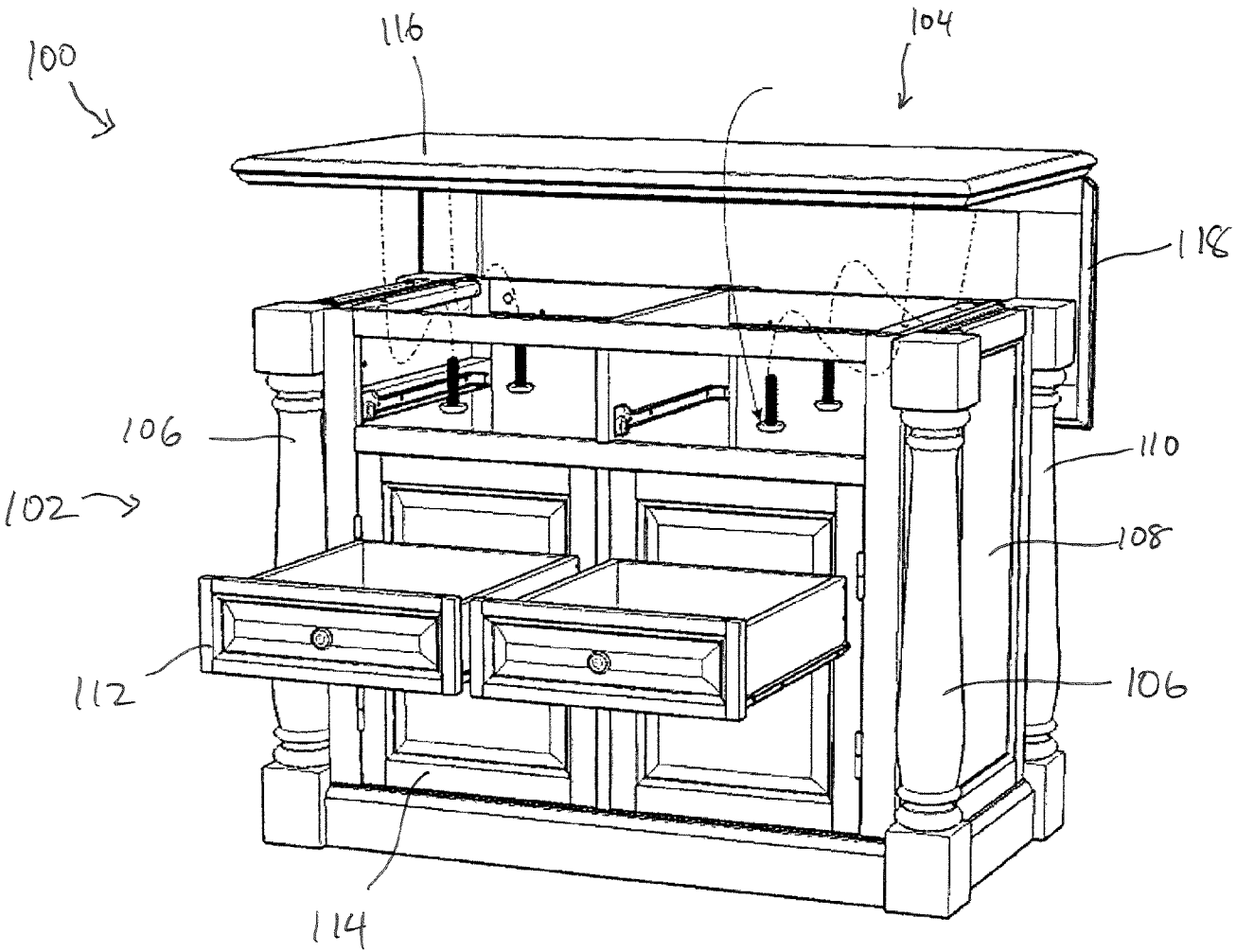
FIG. 4 depicts a front, perspective view of the furniture system of FIG. 1 with its drawers removed and a surface portion separated from a body portion.

FIG. 4 shows furniture system (100) with surface (104) and leaf (118) separated from base portion (102) with drawers (112) removed to show how surface (104) and leaf (118) may be placed onto and attached to base portion (102). Furthermore in FIG. 4, moveable legs (110) are in a retracted position. As a result, leaf (118) is folded down. It will be appreciated that when moveable legs (110) are in the retracted position and leaf (118) is folded down, moveable legs (110) have an appearance such that an observer cannot necessarily tell that moveable legs (110) may be extended from base portion (102). Similarly, when leaf (118) is folded down, it may not be apparent to an observer that leaf (118) is able to be opened. As a result, furniture system (100) has a cohesive appearance regardless of whether moveable legs (110) are in a retracted position or an extended position and regardless of whether leaf (118) is folded downward or extended upwards.

In one exemplary use of furniture system (100), furniture system (100) may be configured such that leaf (118) is folded down and moveable legs (110) are retracted into base portion (102) of furniture system (100). It will be appreciated that perhaps the user desires a larger surface top or a larger footprint of furniture system (100) so as to fill an appropriate amount of space. The user may then extend leaf (118) moving it to an opened position and then the user may pull moveable legs (110) outward from base portion (102) such that moveable legs (110) move to an extended position. Once extended, moveable legs (110) are operable to support leaf (118) such that leaf (118) may act as a stable surface as part of furniture system (100). In some scenarios, the user may decide that the user desires furniture system (100) to take up less space and/or that furniture system (100) should have a smaller surface top. The user may then push moveable legs (110) into base portion (102) and fold down leaf (118), thereby reducing the footprint of furniture system (100) as well as the overall space taken up by furniture system (100). It will be appreciated that the above described usage of furniture system (100) is merely exemplary and other suitable ways of using furniture system (100) may be apparent to one of ordinary skill in the art in view of the teachings herein.

It should be understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. A furniture piece comprising:

(a) a body;

(b) a surface comprising a surface portion and a leaf portion, wherein the leaf portion is moveable in relation to the surface portion, wherein the surface is in communication with the body;

(c) at least one moveable leg in communication with the body, wherein the at least one moveable leg is moveable between a retracted position and an extended position, wherein the at least one moveable leg in the extended position is operable to provide structural support to the leaf portion, wherein the at least one moveable leg defines a first end and a second end, wherein the first end and the second end are located at opposing ends of the at least one moveable leg, wherein the second end is configured to rest on a floor surface, wherein at least a portion of the second end forms a foot of the at least one moveable leg;

(d) at least one stationary leg in communication with the body, wherein the at least one stationary leg is affixed to the body such that the at least one stationary leg is configured to remain stationary in relation to the body, wherein the at least one moveable leg appears visually identical to the at least one stationary leg;

(e) an upper beam in communication with the first end of the moveable leg, wherein the at least one moveable leg is in communication with the body through the upper beam; and (f) a lower beam vertically spaced from the upper beam and directly connected to the foot of the moveable leg, wherein the at least one moveable leg is in communication with the body through the lower beam.

2. The furniture piece of claim 1, wherein the upper beam comprises a first rail, wherein the lower beam comprises a second rail, wherein the first rail and the second rail are operable to slidably move the at least one moveable leg relative to the at least one stationary leg.

3. The furniture piece of claim 1, wherein the surface portion and the leaf portion have a rectangular shape.

4. The furniture piece of claim 1, wherein the furniture piece comprises an island.

5. The furniture piece of claim 1, wherein the furniture piece comprises a table.

6. The furniture piece of claim 1, wherein the furniture piece comprises a desk.

7. The furniture piece of claim 1, wherein the furniture piece comprises a server.

8. The furniture piece of claim 1, wherein the furniture piece comprises a sideboard.

9. An apparatus comprising:

(a) a furniture body having a top surface, a front face, and a rear portion, wherein the front face of the furniture body comprises at least one handle or knob, wherein the rear portion is opposingly positioned relative to the front face of the furniture body;

(b) a leaf portion, wherein the leaf portion is hingedly in communication with the top surface of the furniture body, wherein the leaf portion is configured to move pivotally relative to the rear portion of the furniture body;

(c) a plurality of moveable legs in communication with the furniture body, wherein at least a portion of the plurality of moveable legs are configured to retract into the rear portion of the furniture body, wherein the plurality of moveable legs are configured to slidingly extend from the rear portion, wherein the leaf portion is operable to be supported by the plurality of moveable legs when the plurality of moveable legs are extended from the rear portion; and (d) at least one rail in communication with the plurality of moveable legs, wherein the at least one rail is operable to provide sliding movement between the plurality of moveable legs and the furniture body, wherein each of the plurality of moveable legs are configured to be separately moveable in relation to the furniture body, wherein the at least one rail slides relative to the furniture body and is at a bottom of at least one of the plurality of movable legs.

10. The apparatus of claim 9, wherein the furniture body comprises an island.

11. The apparatus of claim 9, wherein the furniture body comprises a buffet table.

12. The apparatus of claim 9, wherein the leaf portion has a rectangular shape.

13. The apparatus of claim 9, wherein the plurality of moveable legs comprises two moveable legs.

14. The apparatus of claim 9, wherein the furniture body and the leaf portion are in communication through a hinge.

15. The apparatus of claim 9, wherein the furniture body comprises a desk.

16. The apparatus of claim 9, wherein the furniture body comprises a server.

* * * * *